US005907745A

United States Patent [19]

Azuma et al.

[11] Patent Number: 5,907,745

[45] Date of Patent: May 25, 1999

[54] IMAGE FORMING APPARATUS HAVING ARRANGEMENT OF SHEET SUPPORT MEMBERS AND AIR DUCTS

[75] Inventors: Jun Azuma, Yokohama; Yoshinori Sugiura, Kawasaki; Seietsu Miura, Kawasaki; Tatsuo Hamada, Kawasaki; Hiroshi Goto; Akira Kuroda, both of Yokohama; Takeshi Niimura, Musashino; Yoshihiro Matsuo, Yokohama, all of Japan

[73] Assignee: Canon Kabushiki Kaisha, Tokyo, Japan

[21] Appl. No.: 08/850,818

[22] Filed: May 2, 1997

Related U.S. Application Data

[63] Continuation of application No. 08/429,094, Apr. 26, 1995, abandoned.

[30] Foreign Application Priority Data

Apr. 28, 1994 [JP] Japan ..... 6-113981
Apr. 7, 1995 [JP] Japan ..... 7-082502

[51] Int. Cl.[6] ..... G03G 21/20

[52] U.S. Cl. ..... 399/92; 399/107

[58] Field of Search ..... 271/223; 399/92, 399/107, 111, 388, 397, 400, 118, 124

[56] References Cited

U.S. PATENT DOCUMENTS

| | | | |
|---|---|---|---|
| 4,873,548 | 10/1989 | Kobayashi et al. . | |
| 5,028,966 | 7/1991 | Kozuka et al. | 399/113 |
| 5,047,803 | 9/1991 | Kanoto . | |
| 5,159,391 | 10/1992 | Koshi et al. | 399/316 |
| 5,160,964 | 11/1992 | Takahashi et al. | 399/113 |
| 5,175,583 | 12/1992 | Noh et al. | 355/200 |
| 5,203,552 | 4/1993 | Hoshi et al. . | |
| 5,218,411 | 6/1993 | Kosugiyama et al. | 399/341 |
| 5,257,068 | 10/1993 | Sawada et al. | 399/125 |
| 5,436,698 | 7/1995 | Ohtaka | 399/113 |
| 5,471,280 | 11/1995 | Taguchi | 399/330 |
| 5,479,245 | 12/1995 | Hino et al. | 399/31 |
| 5,512,975 | 4/1996 | Kitsu et al. | 355/200 |

FOREIGN PATENT DOCUMENTS

| | | |
|---|---|---|
| 392529 | 10/1990 | European Pat. Off. . |
| 56-038069 | 4/1981 | Japan . |
| 60-168167 | 8/1985 | Japan . |
| 61-168167 | 8/1985 | Japan . |
| 62-254161 | 11/1987 | Japan . |
| 63-006581 | 12/1988 | Japan . |
| 3-162360 | 7/1991 | Japan . |
| 3-249060 | 7/1991 | Japan . |
| 4-86837 | 3/1992 | Japan . |
| 5-301398 | 11/1993 | Japan . |
| 5-301400 | 11/1993 | Japan . |

*Primary Examiner*—Robert Beatty
*Attorney, Agent, or Firm*—Fitzpatrick, Cella, Harper & Scinto

[57] ABSTRACT

An image forming apparatus for forming an image on a recording material includes an image bearing member; and optical mechanism for projecting light corresponding to image information onto the image bearing member; a developer for developing a latent image formed on the image bearing member into a toner image; a transfer mechanism for transferring the toner image onto a recording material; a fixer for fixing the toner image transferred onto the recording material; a first support for supporting the recording material to be fed to the transfer mechanism; and a second support for supporting the recording material which has been subjected to a fixing operation of the fixer. Air ducts are provided along the back side supporting surfaces of the first support and the second support which overlap in a horizontal direction with the optical mechanism therebetween. A sheet feeding position, an image transfer position, and an image fixing position take lower positions in the order named.

48 Claims, 5 Drawing Sheets

IMAGE FORMING APPARATUS HAVING ARRANGEMENT OF SHEET SUPPORT MEMBERS AND AIR DUCTS

This application is a continuation of application Ser. No. 08/429,094, filed Apr. 26, 1995, now abandoned.

FIELD OF THE INVENTION AND RELATED ART

The present invention relates to an image forming apparatus for forming a image on a recording material.

Here, the image forming apparatus includes an electrophotographic copying machine, an electrophotographic printer (for example, LED printer, laser beam printer), an electrophotographic facsimile machine, an electrophotographic word processor, and the like.

In an electrophotographic image forming apparatus using an electrophotographic image forming process, an electrophotographic photosensitive member is electrically charged, and is exposed to image light to form an electrostatic latent image, which is developed with a toner into a toner image. The toner image is transferred onto a recording material, and the transferred toner image is fixed on the recording material.

In such an electrophotographic image forming apparatus, reduction of the size is desired.

Examples of downsizing will be described.

In a first example, a sheet feeding cassette is provided substantially horizontally below the bottom of a box type apparatus. In a sheet passage formed thereabove, a process cartridge and a fixing device are disposed. Above them, a sheet discharging tray is provided. By doing so, they are vertically stacked in the structure so that the foot print of the apparatus is reduced. This example is disclosed in U.S. Pat. No. 4,873,548, for example.

In a second example, a sheet feeding tray is disposed below the box type apparatus, and a discharging tray is provided thereabove, as discloses in U.S. Pat. No. 5,047,803, for example.

In a third example, a sheet feeding cassette and a discharging tray are vertically positioned, as disclosed in Japanese Laid-open Patent Applications Nos. 301398/1993 and 301400/1993.

These examples are intended to reduce the size of the foot print.

The present invention is intended to provide a further improvement.

SUMMARY OF THE INVENTION

Accordingly, it is a principal object of the present invention to provide an image forming apparatus having a further reduced foot print size.

It is another object of the present invention to provide an image forming apparatus wherein the inside of the apparatus can be cooled efficiently.

It is a further object of the present invention to provide an image forming apparatus wherein a first supporting means for supporting a recording material and a second supporting means for supporting a recording material having a formed image are overlaid in a horizontal direction with optical means therebetween.

It is a yet further object of the present invention to provide an image forming apparatus wherein the air inside the apparatus can be discharged along a supporting means for the recording material.

It is a yet further object of the present invention to provide an image forming apparatus to which a process cartridge is detachably mountable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
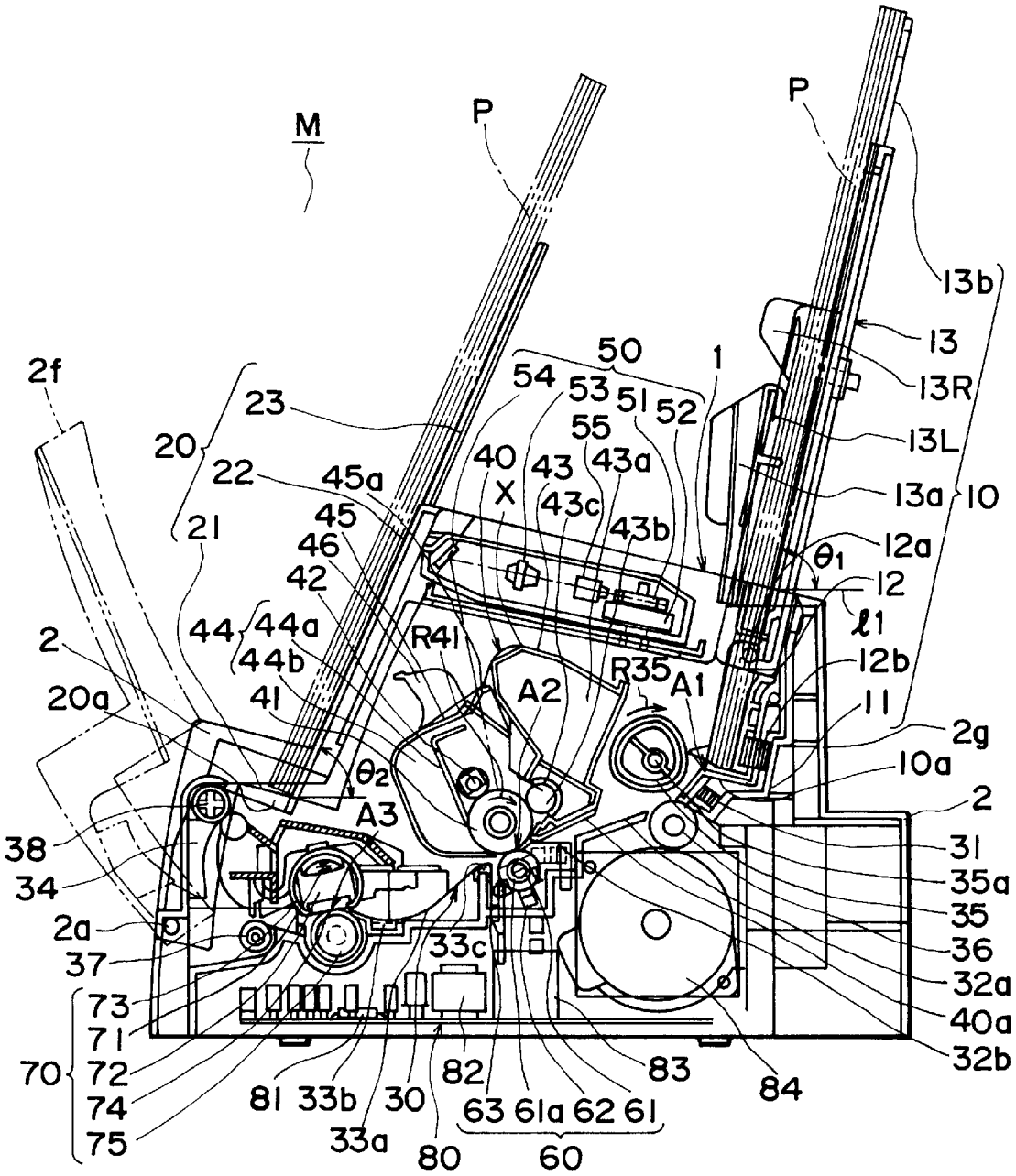
FIG. 1 is a longitudinal sectional view of an image forming apparatus according to an embodiment of the present invention.

FIG. 1 shows an exemplary electrophotographic image forming apparatus in the form of a laser beam printer M usable with a process cartridge. In this Figure and subsequent Figures, the left side is a front side and right side is a rear side. With this, the rear side is an upstream side, and the front side is a downstream side, with respect to a movement direction of a recording material P. As the recording material P usable with this apparatus, there are usual plain paper, thick sheet of paper, envelope or other special sheet, or an OHP film of non-paper material. In the following, the description will be made as to usual sheet of paper.

The laser beam printer (printer) will be described. The printer M comprises a main assembly 1. In the following description, the main assembly includes an outside frame and an inside frame. At the rear of the main assembly 1, there is provided a first supporting means 10 for supporting vertically the recording material P before image formation thereon, and at the front, there is provided a second supporting means 20. A bottom end 10*a* of the first supporting means 10 and a bottom end 20*a* of the second supporting means 20 are connected by a passage 30 extending from the rear of the main assembly 1 toward the front so as to form a generally U-shaped path (longitudinal U-path).

The printer M further comprises a process cartridge 40 containing as a unit an electrophotographic photosensitive drum 41 or the like right above the passage 30 and the like, information light emitting means 50 disposed above the process cartridge 40, image transfer means 60, and fixing means 70 disposed right below the bottom end of the second supporting means 20 downstream of the passage 30. With the U-shaped path as a reference, the process cartridge 40 and the information light emitting means 50 are inside of the U-shaped path, and the transfer means 60 is outside thereof. The fixing means 70 bridges the passage 30 at the downstream side.

The operation of the printer M will be described. A toner image is formed on the photosensitive drum 41 corresponding to the light image applied by the information light emitting means 50 in the form of a laser emitting means for emitting a laser beam, and the like. On the other hand, the recording material P is fed out face down from the first supporting means 10, and is supplied to photosensitive drum 41 through an upstream side of the passage 30. On the recording material P, the toner image is transferred from the photosensitive drum 41 by the transfer roller 61. The recording material P now having the transferred image is subjected to the image fixing operation, and is discharged face up, and is supported vertically by the second supporting means 20.

In such a printer M, i.e., a printer having the U-shaped path, the foot print of the main assembly 1 can be reduced irrespective of the length of the recording material P in the feeding direction therefor, by reducing the length of the passage 30 in the horizontal direction. The printer M has some heat emitting elements. For example, they includes the fixing means 70, and controller 81, AC input portion 82, high voltage generating portion 83, motor 84 and so on, which will be described hereinafter. On the other hand, there are elements which are not durable against heat, such as the information light emitting means 50, and developing device 43 which will be described hereinafter. When the passage 30 is shortened in an attempt to reduce the foot print or the area occupied by the apparatus, the density of the arrangement of these elements is increased with the result that the elements are closer. This embodiment employs a structure to avoid the problem due to the heat, and the passage 30 is shortened. The structures to avoid the problem due to the heat is used as desired, and not inevitable to the present invention.

The structure for shortening the passage 30 while avoiding the problem of the heat, will be described.

The first supporting means 10 is at the bottom of main assembly 1, and comprises an abutment 11, end support 12, and a sheet feeding tray 13, in this order from the bottom. The abutment 11 supports the bottom the recording material P at the leading end thereof to bear the weight of the recording material P. The end support 12 is supported for swinging motion to and fro by the main assembly 1 with the axis of s shaft 12*a*. It is urged to the front by a spring 12*b* disposed at the back side of the bottom end. The end support 12 urged to the front is retracted to the back by a cam (not shown) before the sheet feeding, and it urges the recording material P to the front by the rotation of the unshown cam only upon the sheet feeding operation.

The topmost recording material P of the recording materials before the feeding, is placed at a feeding position by the 1 and a separation claws and waits for the feeding. When the recording material P is fed, the next recording material P is placed at the position by the end support 12 urged by the spring 12*b*. The feeding tray 13 is disposed such that it projects from the top rear end of the main assembly 1 in the longitudinal direction (see also FIG. 5). The feeding tray 13 supports the middle and trailing end portions of the recording material P at the back side, thus keeping a flat state of the entirety of the recording material P in the longitudinal direction.

At the front side of feeding tray 13, there are two movable regulating plate 13L and regulating plate 13R for regulating lateral positions of the recording material P, and a manual guide 13*a* for guiding recording material P manually fed. The manual guide 13*a* is provided with movable regulating plate 14L and regulating plate 14R. On a top end of the feeding tray 13, an upwardly extending extension guide 13*b* (slider) for stably supporting a long recording material P is mounted to the feeding tray 13. The feeding tray 13 is detachably mounted to a top surface of an outer casing 2 of the main assembly 1.

In this embodiment, a first supporting angle θ for supporting the recording material P before the image formation, that is, the angle formed between a horizontal plane 11 and the recording material P supported flat by the first supporting means 10 comprising the abutment 11, the end support 12, the feeding tray 13 and so on, is approx. 60–90 degrees. By this, the foot print can be reduced, and the recording material P can be fed with efficient use of gravity. The first supporting angle is preferably approx. 70–75 degrees.

The second supporting means 20 is disposed at the front part of main assembly 1, while the first supporting means 10 is disposed at the rear. The second supporting means 20 constitutes a part of the outer casing 2, and is mounted to a cover 2*f* rotatable relative to the fixed portion 2*g* of the casing 2. In the Figure, the chain line indicates the cover 2*f* on half way of opening or closing motion. It comprises an abutment 21, a discharge tray 22 and an extension tray 23 (slider), in this order from the bottom.

The abutment 21 supports the recording material P after the image formation at the back side of the trailing end portion thereof. The discharge tray 22 (outer surface of the cover 2*f*) supports the latter part thereof at the back side. The extension tray 23 supports the back side of the leading portion thereof. The extension tray 23 is substantially vertically movably supported by the discharge tray 22, in other words, it is slidable relative to the cover 2*f*. The extension tray 23 extended upwardly and the discharge tray 22 support flat the recording material P after the image formation in the longitudinal direction.

A second supporting angle θ2 of the recording material P longitudinally supported relative to a horizontal plane is approx. 55–75 degrees the preferable range is approx. 65–70. As to the opening and closing operations of the outer casing 2 having a discharge tray 22 or the like, the description will be made hereinafter.

The passage 30 connects the bottom portion 10*a* of the first supporting means 10 and the bottom portion 20*a* of the second supporting means 20, and constitutes a passage for the recording material P extending from the rear of the main assembly 1 and toward the front. The passage 30 is provided with a separation pad 31, a pre-transfer guide 32*a*, a pre-transfer guide 32*b*, a post-transfer guide 33*a*, a post-transfer guide 33*b*, and an inverse guide 34, in this order from the rear (upstream) to the front (downstream).

Above the separation pad 31, there is a feeding roller 35, and below the feeding roller 35, there is a transportation roller 36. The feeding roller 35 has an outer peripheral surface eccentric relative to its shaft 35*a*. By the rotation in the direction R35, the topmost sheet P is fed out from the first supporting means 10. By cooperation with the separation pad 31, the double feed of the recording material P is avoided, and the recording material P is fed by the transportation roller 36. The upstream pre-transfer guide 32*a* is slightly slanted down toward the front, and the downstream pre-transfer guide 32*b* is substantially horizontal.

Between them and the bottom surface 40*a* of the upper process cartridge 40, the recording material P is guided to direct the recording material P to a transfer position A2 formed between the photosensitive drum 41 and the transfer roller 61 as transfer means 60. The post-transfer guide 33*a* is slanted down toward the front, and the post-transfer guide 33*b* continuing thereto has a smooth recess. The recording material P having received the toner image from the photosensitive drum 41 in the transfer 2 position, is directed along the post-transfer guide 33*a* and post-transfer guide 33*b* to an image fixing position A3 formed between a fixing film 74 and a pressing roller 75, which will be described hereinafter.

At the most upstream position of the post-transfer guide 33*a*, there is a discharging member 33*c* for removing an excessive charge on the recording material P after the toner image transfer. The inverse guide 34 is in the form of a smoothly curved guide extended between the feeding roller means 37 immediately downstream of the fixing means 70 and the discharging roller means 38 thereabove. It directs the recording material P after the toner image fixing to the second supporting means 20. The inverse guide 34 is formed integrally with the outer casing 2.

The passage 30 is extended along the sheet feeding position A1, the image transfer position A2, the fixing position A3. These positions are lowered in this order. Therefore, the recording material P is transported along the direction of the gravity. The recording material P is supported at the bottom of the leading portion thereof by the pre-transfer guide 32*a*, the pre-transfer guide 32*b* and the post-transfer guide 33*a*, post-transfer guide 33*b*, and therefore, it is stably fed. Thus, the recording material P is fed to the positions A2 and A3 with certainty to reduce the possibility of the sheet jam.

As described above, the position A1 where the recording material P is fed out by the feeding roller 35 from the stack on the first supporting means 10 (end portion having the abutment 11), the position A2 here the recording material P receives the toner image from the photosensitive drum 41 (the nip position between the photosensitive drum 41 and the transfer roller 61), and the position A3 where the toner image is fixed on the recording material P (the nip between the ceramic heater 74 and the pressing roller 75), are located at positions lower in this order.

Thus, despite that the foot print of the printer M is reduced by making the first supporting means 10 and second supporting means 20 vertical, the occurrence of the sheet jam can be reduced significantly. In this embodiment, the transfer position A2 is lower by approx. 2.5 cm (Y1 in FIG. 6) than the feeding position A1. The fixing position A3 is lower by approx. 4.6 cm than the feeding position A1. Therefore, the fixing position A3 is lower by approx. 2.1 cm than the transfer position A2 (Y2 in FIG. 6).

Figure 6:
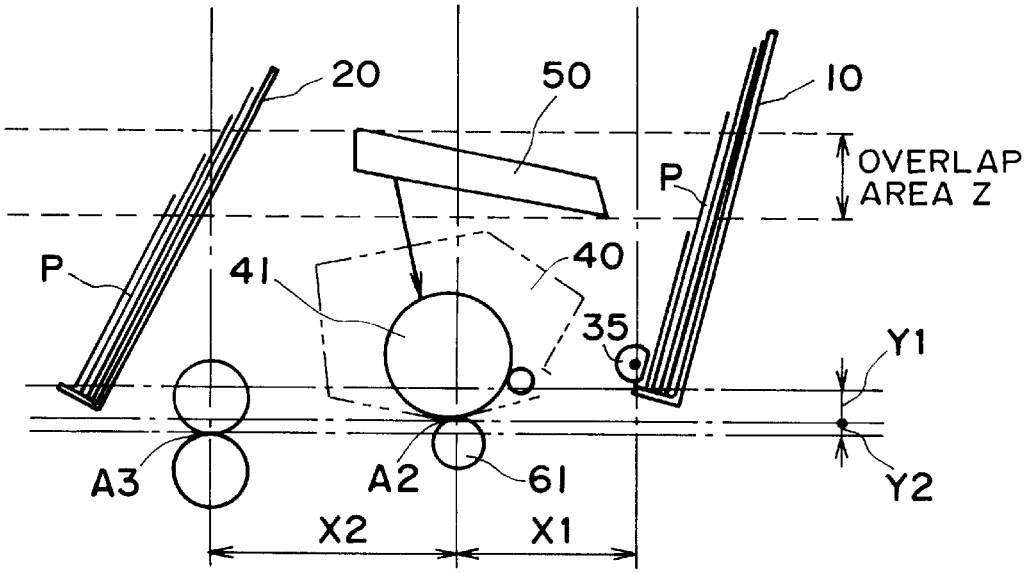
FIG. 6 shows positional relationships among various means constituting the apparatus, according to an embodiment of the present invention.

The interval, in the horizontal direction, between the feeding position A1 and the a2 is approx. 6.8 (X1 in FIG. 6); the interval between the transfer position A2 and the fixing position A3 is approx. 7.0 cm (X2 in FIG. 6). As described hereinbefore, the first supporting means 10 and the second supporting means 20 are substantially vertically extended, and the angle θ1 between the horizontal plane $\mathbf{1}_1$ and the surface of the first supporting means 10 for supporting the recording material P, is approx. 60–90 degrees, preferably, approx. 70–73 degrees. The angle θ between the horizontal plane $\mathbf{1}_2$ and the surface of the second supporting means 20 for supporting the recording material P, is approx. 55–75 degrees, preferably, approx. 65–70 degrees.

Therefore, in this embodiment, the recording material supporting surface of the first supporting means 10 and the recording material supporting surface of the second supporting means 20 are overlapped with each other in a horizontal direction with the information light emitting means 50 as optical means (LED array) and an upper half of the process cartridge therebetween. The overlapping zone is shown in FIG. 6 by Z. FIG. 6 is schematic in the scale of each part is not correct.

The process cartridge 40 has as a unit a cartridge container 45, and photosensitive drum 41, charging roller 42, developing device 43 and cleaning device 44 in the cartridge container 45. The process cartridge 40 as a unit is detachably mountable to a main assembly of the image forming apparatus. The photosensitive drum 41 is an electrophotographic photosensitive member, and is rotated in a direction R41 by a driving mechanism having a motor 84 of the apparatus. The charging roller 42 is contacted to a surface of the photosensitive drum 41, and is driven by the rotation of the photosensitive drum 41 in the direction R41. The charging roller 42 is supplied with a DC biased AC voltage by a high voltage generator on a base 80 of the main assembly.

While the photosensitive drum 41 rotates, the surface thereof is charged uniformly. The developing device 43 has a toner container 43*a* and a developing roller 43*b*. The developing roller 43*b* has an inside magnet, and carries the toner on the surface thereof by rotation. A thickness of a layer of the toner is regulated by regulating blade 43*c*, and is electrically charged thereby. The toner is deposited onto the electrostatic latent image formed on the photosensitive drum 41 by the information light emitting means 50, so that a toner image is formed. The developing roller 43*b* supplies the toner to the photosensitive drum 41 in the developing zone.

In the process cartridge 40 of this embodiment, the developing device 43 can have the toner container 43*a* at an upper position and the developing roller 43*b* at a lower position, and therefore, the toner in the toner container 43*a* falls by the gravity toward the developing roller 43*b*. Therefore, there is no need of special mechanism, such as a stirring member, to feed the toner in the toner container 43*a* to the developing roller 43*b*. By this, the structure of the process cartridge 40 can be simplified. The cleaning device 44 includes an elastic cleaning blade 44*a* for contacting to the surface of the photosensitive drum 41 after the toner transfer to remove the toner remaining on the surface, and a a residual toner container 44*b* for collecting the toner removed from the photosensitive drum 41.

The top portion of the cleaning device 44 is provided with a through opening 45*a* to permit projection of the beam modulated in accordance with the image information onto the photosensitive drum 41. The mounting and demounting will be described hereinafter.

The information light emitting means 50 for projecting the image light, projects the image light to the surface of the photosensitive drum 41 through the opening 45*a*, and the entirety thereof is disposed at an upper position. The information light emitting means 50 is provided with a semiconductor laser 55 for emitting a laser beam in response to the image signal, a polygonal mirror 51, a motor 52 for driving the polygonal mirror 51, a lens 53 and a reflection mirror 54.

The polygonal mirror 51 is disposed at a lower position adjacent the first supporting means 10 (rear side), and the reflection mirror 54 is disposed at an upper position adjacent the second supporting means 20 (front side). In other words, the arrangement is higher toward the front, contrary to the passage 30. By doing so, the increase of the height can be suppressed, and the optical path length required by the laser beam from the polygonal mirror 51 to the photosensitive drum 41 by way of a reflection mirror 54, is assured, and in addition, the position of the manual feed guide 13*a* of the first supporting means 10 can be selected in consideration f the operativity. By the projection of the laser beam, the electrostatic latent image can be formed on the photosensitive drum 41 corresponding to the image signal.

The process cartridge 40 and information light emitting means 50 are disposed in the space defined by the first supporting means 10, second supporting means 20, and passage 30, that is, the inside space of the longitudinal U-path, in a compact manner.

The transfer means 60 has a transfer roller 61 contacted to a bottom part of the photosensitive drum 41, and provides a transfer position there. Left and right ends of a core metal 61*a* of the transfer roller 61 are supported by bearings 63 urged by a spring 62, so that the transfer roller 61 is pressed to the photosensitive drum 41 with a predetermined pressure. The 61 is supplied with a transfer voltage of a polarity opposite from the toner image on the photosensitive drum 41, by which the toner image is transferred onto the surface of the recording material P passing through the transfer position A2.

The fixing means includes a ceramic heater 12 supported on the main assembly 1 through a spring 71, a ceramic heater 74 and a pressing roller 75 contacted to the bottom of fixing film 74 to constitute fixing position A3 between the ceramic heater 74. The ceramic heater 72 and the fixing film has low thermal capacity, and the time required from the start of the power supply to the arrival at the fixing temperature is short. By doing so, the heat radiation of the fixing means is minimized. The fixing means 70 fuses the toner image, and fixes it on the recording material P, when the recording material P having received the toner image at an upstream transfer position A2 passes through the fixing position A3.

At a lower position, that is, below the passage 30, there is disposed a base 80. On the base 80, there are controller 81, AC input portion 82, high voltage generating means 83 and motor 84, in this order from the downstream side (front side). These elements are taller in this order. Therefore, on the base 80, tall elements are at the rear portion, and shorter elements are at the front. This matches the structure of the passage 30 which is high at the rear side and which is low at the front side. The positions of the elements on the base 80 are determined matching the space below the passage 30. This is also contributable to the downsizing.

Figure 2:
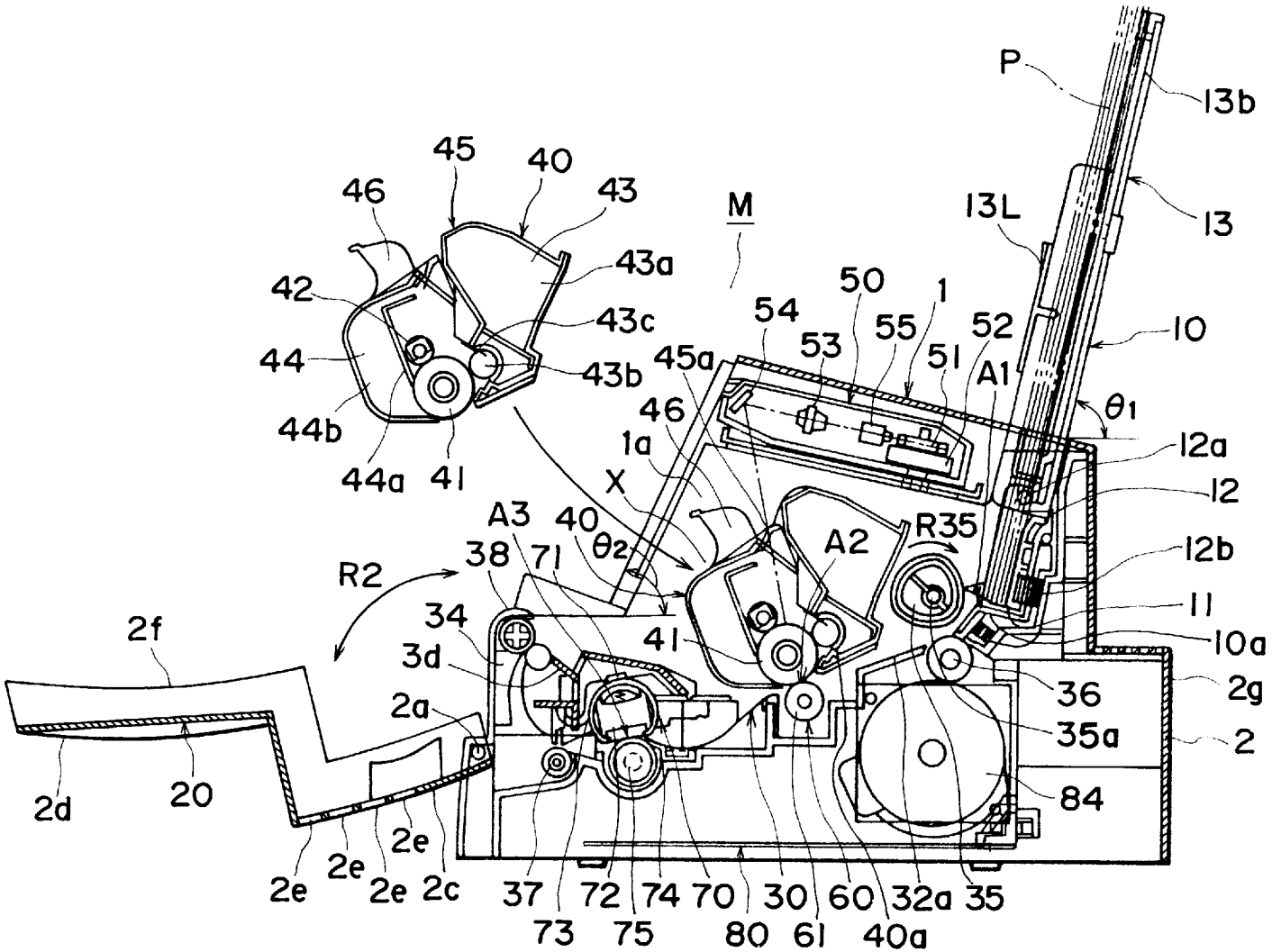
FIG. 2 is an illustration of mounting and demounting operation of a process cartridge in relation with opening and closing actions of an outer cover, in embodiment of FIG. 1.

Referring to FIG. 2, the description will be made as to the opening and closing of the cover 2*a* of main assembly 1 and the mounting and demounting operation of the process cartridge 40.

The main assembly 1 has the outer casing 2, a part of which is a cover 2*f* for covering a front side of the main assembly 1 and functioning as the above-described second supporting means 20. The cover 2*f* is supported for rotation in the direction R2 on a lower hinge 2*a* of the outer casing 2. When the cover 2*f* is opened by rotating it in the counterclockwise direction, a large opening is provided at the front of the main assembly 1. Through the opening, the process cartridge 40 is mounted to the main assembly 1. As described hereinbefore, the passage 30 at the bottom of the space X for mounting the process cartridge 40 lowers toward the front. On the other hand, the information light emitting means 50 above the space rises toward the front, on the contrary to the passage 30, and therefore, the opening la is large to facilitate the mounting and demounting operation of the process cartridge 40. When the process cartridge 40 is demounted, such a part of the passage 30 as is between the feeding position A1 and fixing position A3 is exposed, so that the jam clearance operation of the recording material P is easy. When the process cartridge 40 is mounted or demounted relative to the mounting portion X, the operator grips the grip or handle 46 provided on the top surface of the cartridge container 45.

Figure 3:
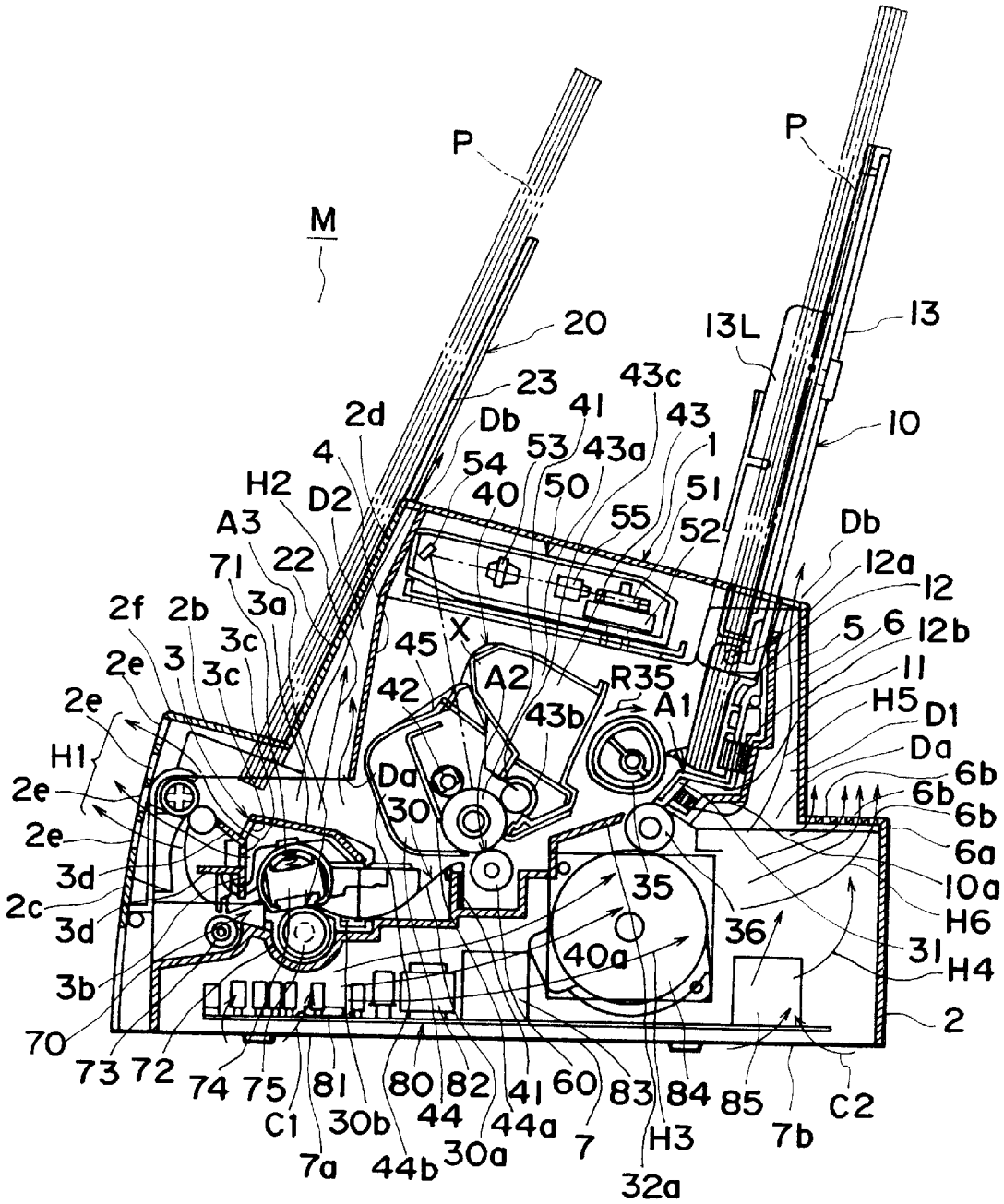
FIG. 3 is a longitudinal sectional view illustrating heat discharging using flow of air in the image forming apparatus of FIG. 1.

Referring to FIG. 3, the description will be made as to the image forming operation of the printer M.

On the first supporting means 10, the recording material P is set vertically. The 41 in the process cartridge 40 is rotated, and the surface thereof is uniformly charged by the charging roller 42 to the negative polarity. The thus charged surface is exposed to the image light by the information light emitting means 50 which emits the laser beam modulated in accordance with the image information. From the portion exposed to the light, the negative toner is disappeared to that the latent image is formed. The electrostatic latent image is developed with a negative charge toner into a toner image by the developing device 43 through reverse development.

On the other hand, the recording material P waiting at feeding position A1 is fed to transfer position A2 by feeding roller 35 in timed relation with the toner image on the photosensitive drum 41. In the transfer position A2, the toner image on photosensitive drum 41 is transferred onto the recording material P by the transfer roller 61 supplied with a transfer voltage of the positive polarity which is the opposite from the polarity of the toner. The recording material P is subjected to the image fixing operation by which the surface toner image is pressed and heated by the fixing means 70. The recording material P is vertically discharged onto the second supporting means 20 by the discharging roller means 38 through a reverse path 34.

The printer M supports vertically the recording material P before and after the image formation by the first supporting means 10 and second supporting means 20, and the passage 30 is shortened, thus reducing the area occupied by the main assembly 1.

In connection with the shortening of the passage 30, the measure is taken against the heat as shown in FIG. 3. This will be explained.

As for heat generating portion in the main assembly 1, there is fixing means 70 having a ceramic heater 74. Above the fixing means 70, there is a hood 3, which has a top plate 3*a* and a front plate 3*b*. The 3*a* rises toward the front so as to direct the heat flow from the fixing means 70 to the front side. The 3*b* is provided with a large number of discharge ports 3*c* at two levels. Below each of the front plate 3*b* a guiding plate 3*d* is projected to guide the heat flow H1 heat flow H1 discharged through the discharge ports 3*c* to the cover 2*f* (outer casing 2).

Figure 5:
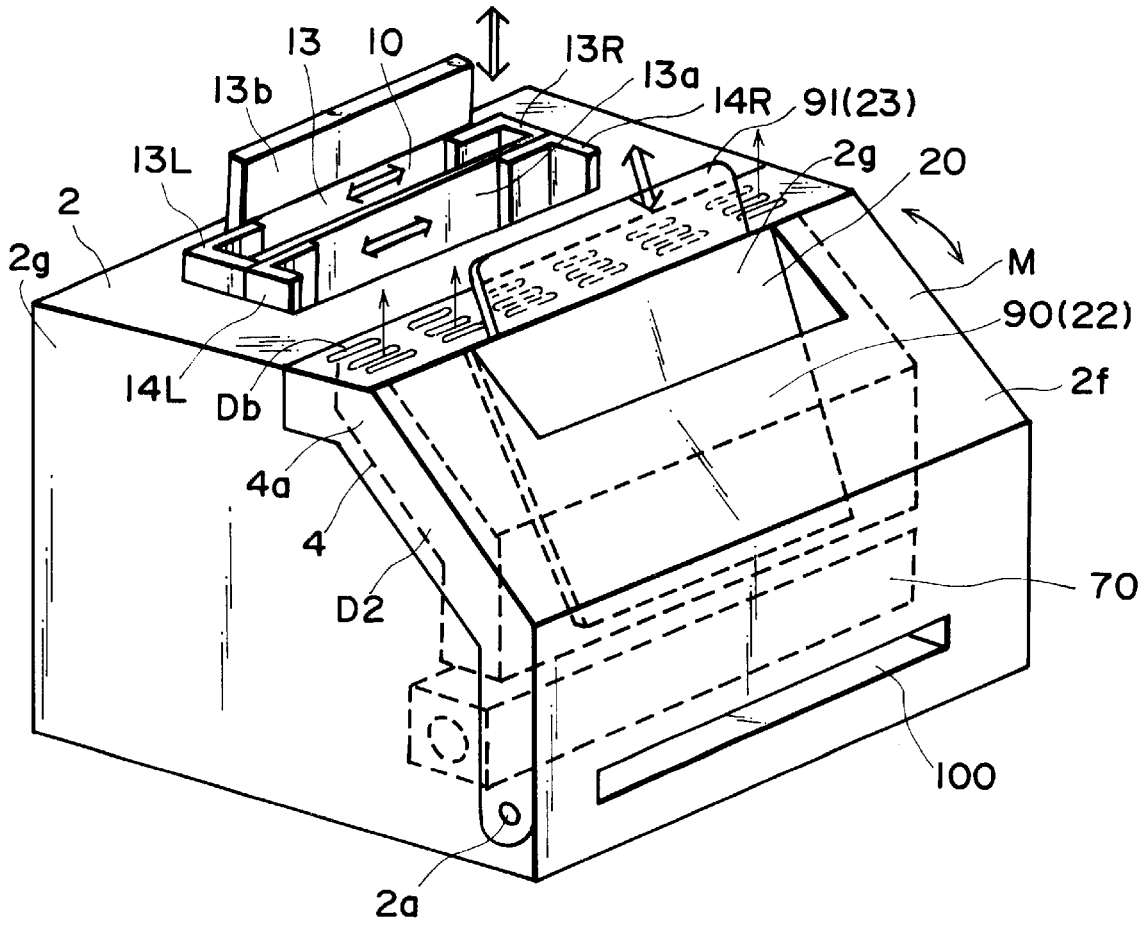
FIG. 5 is a perspective view of an image forming apparatus according to a further embodiment of the present invention.

The outer casing 2 is divided into lower half 2*c* and upper half 2*d*. In the front side of the lower half 2*c*, a large number of discharge openings 2*e* are formed. The heat flow H1 from the hood 3 is discharged to the outside of main assembly 1 through the discharge openings 2*e*. On the other hand, in a back side of the upper half 2*d* of the cover 2*f* (outer casing 2), a second heat discharging duct D2 is formed. The front side, rear side, left side and right side of the second heat discharging duct D2, are constituted by a back side of discharge tray 22 of the second supporting means 20 (the inside of the cover 2*f*), wall (plate) 4 and left and right side walls (FIG. 5 where only one side wall 4*a* is shown). The wall 4 functions to block the heat between the fixing means 70 and photosensitive drum 41 by cooperation with the a residual toner container 44*b* of the cartridge container 45 in the process cartridge 40.

By doing so, the developing device 43 and information light emitting means 50 in the process cartridge 40 which are easily influenced by the heat, are thermally isolated from the heat generated by the fixing means 70. The second heat discharging duct D2 has a large inlet opening Da, and is disposed right above the fixing means 70 and hood 3 when the cover 2*f* is closed. It is extended up along a back side of the discharge tray 22 and has an outlet opening Db in the top side of the main assembly 1. The heat on the hood 3 heated by the fixing means 70 is directed as heat flow H2 to the inlet opening Da of the second heat discharging duct D2 to the outlet opening Db, that is, to the outside of the main assembly 1. In this embodiment, the upper half 2*d* of the cover 2*f* has s top surface slanted downwardly toward the bottom, and the surface of the slanted surface of the upper half 2*d* is used commonly by the discharge tray.

Since the discharge tray 22 is vertically arranged, the back side (inside surface of the upper half 2*d* of the cover 2*f*) is used also as a part of the second heat discharging duct D2. By providing the partition wall 4 on the upper half 2*d* faced to the inside surface of the upper half 2*d*, the second heat discharging duct D2 can be easily formed. Thus, in this embodiment, the discharge tray 22 and partition wall 4 are integral with cover 2*f* (outer casing 2), in other words, the second heat discharging duct D2 is integral with cover 2*f* (outer casing 2). Therefore, when the cover 2*f* is opened as shown in FIG. 2, the second heat discharging duct D2 also moves, the second heat discharging duct D2 does not interfere with the process cartridge 40 when it is mounted or demounted relative to the main assembly 1.

As described in the foregoing, the heat from the fixing means 70 is efficiently discharged to the outside of the main assembly 1 by the heat flow H1 formed by the hood 3, the discharge ports 3*c*, the discharge openings 2*e* of the outer casing 2 and so on, and by the heat flow H2 formed by the second heat discharging duct D2. Therefore, the process cartridge 40 can be disposed close to the fixing means 70 so that the passage 30 can be shortened.

The description will be made as to the heat generated from the elements below the passage 30. On the base 80 below the passage 30, there are controller 81, AC input portion 82, high voltage generating means 83 and motor 84. The heat therefrom forms heat flow H3 which flows to the back along a bottom surface of the passage 30 which lowers to the front, and discharges through the rear side of the main assembly 1. In the rear part of the main assembly 1, there is a first heat discharging duct D1 having front, rear, left and right sides constituted by a rear plate 5, constituting a part of the main assembly 1. On the outer casing 2 at a back side of the first supporting means 10, rear plate 6 (a part of outer casing 2) constituting the main assembly 1 and left and right plate (not shown).

The first heat discharging duct D1 has a plurality of bottom large openings Db. The rear plate 6 (outer casing 2) has a stepped portion 6*a* substantially at a middle level. The stepped portion 6*a* is provided with a large number of discharge openings 6*b* extending vertically. Sucking ports 7*a* and sucking ports 7*b* are formed at a front side and rear side of the bottom 7 of the main assembly 1, i.e., below the controller 81 and high voltage generating means 85, respectively.

With such a structure, the heat from the heat generating portion on the base 80 forms heat flow H3 flowing along the passage 30 to the back side. In the rear portion, an upward heat flow H4 is formed, and it flows up as a heat flow H5 heat flow H5 in the first heat discharging duct D1. It is discharged to the outside of main assembly 1 through the discharge openings 6*b* as the heat flow H6. Corresponding to the discharge, cool air C1 and cool air C2 are introduced into the main assembly 1 through a plurality of openings 7*a* at the front part of the openings 7 and through a plurality of openings 7*b* in the rear part thereof.

As described in the foregoing, the heat is treated differently in the upper part and the lower part of the passage 30, i.e., inside and outside of the unshaped path. In the inside, the fixing means 70 is thermally isolated. The heat from the fixing means 70 is discharged two ways, i.e., to the front side of the main assembly 1 through discharge openings 2*e* and so on of the outer casing 2 as heat flow H1 and to the top of the main assembly 1 through the second heat discharging duct D2 as heat flow H2. At the outside of the unshaped path, the heat flow from the elements on the base 80 is prevented from going to the process cartridge 40 (inside of the u-shaped path) by the passage 30.

Then, the heat flow is directed to the back as heat flow H3 along the bottom surface of the passage 30 rising toward the back, and is discharged through first heat discharging duct D1 as heat flow H5 and through discharge openings 6*b* as heat flow H6, together with heat flow H4. According to this embodiment, as described hereinbefore, effective heat flows H1–H6 can be formed by the first heat discharging duct D1, second heat discharging duct D2 and the bottom surface of passage 30. By this, the necessity of discharging fan for forming the heat flow can be avoided. However, the fan or the like may be employed as desired. According to this embodiment, the inside temperature rise can be effectively avoided.

As described in the foregoing, by the establishment of heat flows H1–H6, the process cartridge 40 and fixing means 70 can be disposed closely with each other. As a result, the passage 30 can be shortened. In addition to the shortening of the passage 30, the recording material P before and after the image formation can be supported vertically by the first supporting means 10 and the second supporting means 20, so that the area occupied by the main assembly 1 can be reduced.

Embodiment 2

Figure 4:
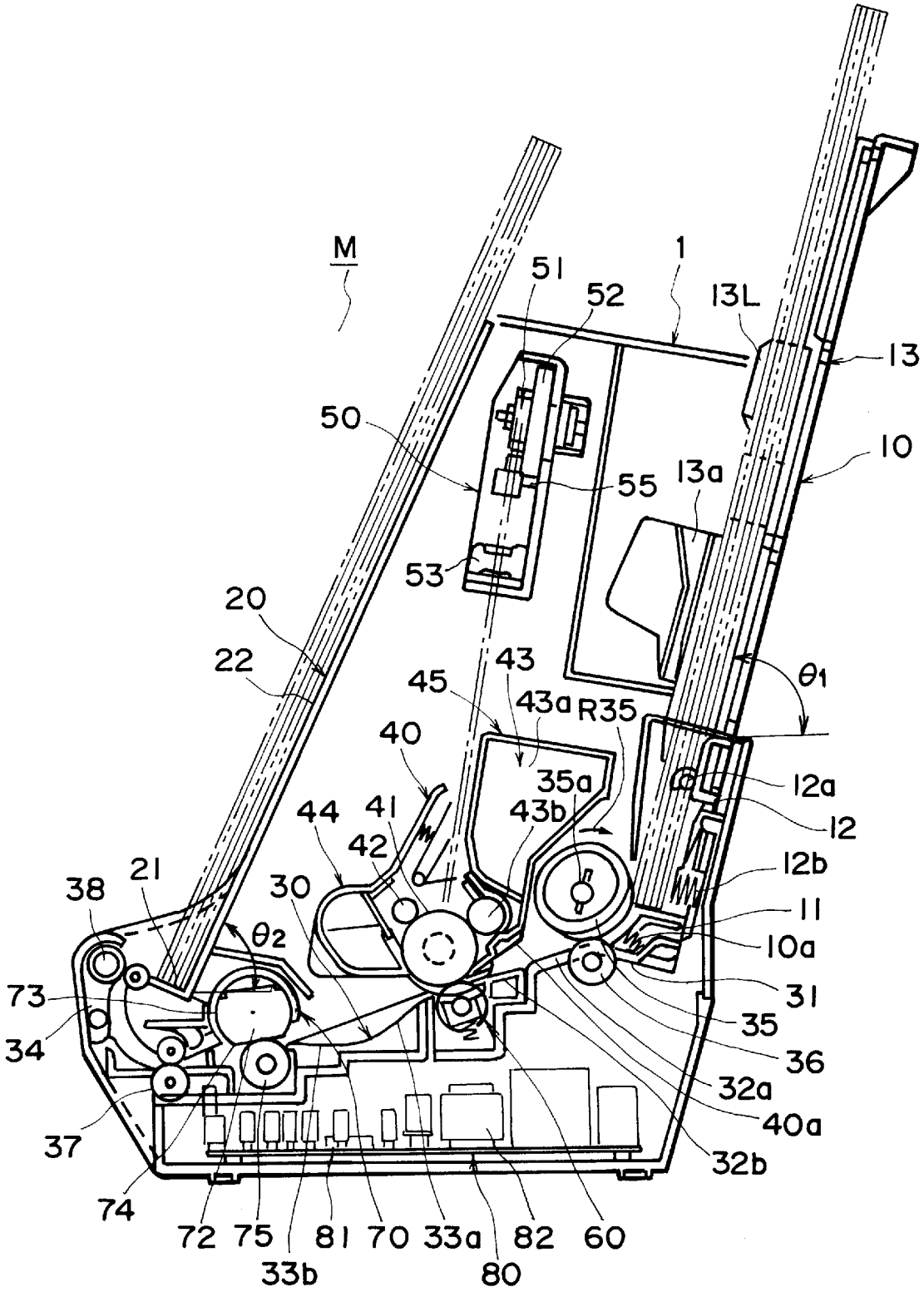
FIG. 4 is a longitudinal sectional view of an image forming apparatus according to another embodiment of the present invention.

Referring to FIG. 2, a second embodiment will be described. As shown in FIG. 4, the information light emitting means 50 is arranged vertically similarly to first supporting means 10 and second supporting means 20. The reflection mirror 54 in FIG. 1 arrangement is positively omitted to directly expose the surface of the photosensitive drum 41. By doing so, the height of the main assembly 1 increases, but the front-rear dimension of the main assembly 1 can be reduced. By doing so, the the latitude of the second supporting angle θ2 for the recording material P by the second supporting means 20 is increased without enlarging the foot print.

Embodiment 3

This embodiment is similar to the embodiment with FIGS. 1–3. But the second supporting means 20 is provided in the inside of the cover 2*f*, the same being provided outside thereof in the foregoing embodiment. The same reference numerals are assigned for the elements having the corresponding functions. In FIG. 5, only the fixing means 70 is shown, but the main assembly 1 is the same as with the foregoing embodiment.

In this embodiment, second heat discharging duct D2 is provided on the cover 2*f*. At the inside of the cover 2*f*, there are a discharge tray 90 (22) inclined down toward the upper portion and an extension tray 91 (23), and a second supporting means 20 is constituted by a projection (not shown in FIG. 5), the discharge tray 90 and the extension tray 91.

Therefore, the recording material P is projected through the opening 2*g* of the cover 2*f*, and is supported by the discharge tray 90 and the extension tray 91. A short recording material P is supported only by the discharge tray 90. In this case, the operator takes the recording material P supported by discharge tray 90 through opening 2*g*. The cover 2*f* has three lines of outlet opening Db in a back side of the extension tray 91 to discharge the air flow directed by the second heat discharging duct D2. Designated by 100 is a discharge port in the cover 2*f*. It is effective to discharge a thick recording material such as post card. By discharging the recording material P through this port 100, the recording material P can be maintained non-curved, as compared with the case of use of second supporting means 20.

According to this embodiment, the second supporting means 20 is provided inside the cover 2*f*, so that the recording material P can be further stably supported.

In all of the foregoing embodiments, the first supporting means 10 and second supporting means 20 vertically supports the recording material P before and after image formation, so that the foot print of the main assembly 1 is not directly influenced by the length of the recording material P measured in the direction of feeding thereof. By reducing the length passage 30 connecting the two supporting means to less than the length of the recording material P in the feeding direction, the area occupied by the main assembly 1 can be reduced.

The image transfer position is lower than the position of the recording material feeding, and the fixing position is further lower than the transfer position, so that the recording material P is fed along the gravity, and therefore, the leading edge is stable to permit smooth feeding.

The second heat discharging duct is provided at the back side of the second supporting means 20, so that the heat from the fixing means can be discharged effectively along the second supporting means 20, and therefore, the fixing means can be disposed close to the image bearing member, for example, so that the passage 30 can be shortened correspondingly.

The second heat discharging duct has a partition wall, so that the fixing means can be further closer to the image bearing member.

Embodiment 4

In the foregoing embodiment, an LED array is usable in place of the information light emitting means 50 in the form of a laser beam emitting means (optical means). Along the surface of the photosensitive drum 41, a large number of LED are disposed. While rotating the photosensitive drum 41, the LED are selectively actuated in accordance with the image signals, so that a latent image is formed. By this, the structure is further simplified and downsized.

Embodiment 5

The process cartridge 40 is not limited to the one containing the elements shown in FIG. 1. It may contain an electrophotographic photosensitive member as an image bearing member, and at least one of process means such as charging means, developing means, cleaning means as a unit into a cartridge which is detachably mountable to the main assembly of the image forming apparatus.

It may contain an electrophotographic photosensitive member as an image bearing member, and charging means, developing means or cleaning means (process means) as a unit into a cartridge which is detachably mountable to the main assembly of the image forming apparatus. Or, it may contain an electrophotographic photosensitive member as an image bearing member and developing means as process means.

Embodiment 6

The first supporting means 10 in the foregoing embodiment, can be formed mainly as a feeding cassette. At the rear of the main assembly 1, a vertical cassette mounting portion is provided, and a cassette containing the recording material is inserted vertically from the top so that the recording material P are vertically supported. In this case, the first supporting means 10 is formed by the cassette mounting portion and the cassette. Here, the cassette means a member containing the recording material P and detachably mountable to the cassette mounting portion.

According to this embodiment, a vertical u-shaped path is formed by the first supporting means 10 and the second supporting means 20 and the passage 30 therebetween. The image bearing member is disposed inside the u-shaped path above the passage 30, and the information light emitting means 50 is disposed inside the unshaped path above the image bearing member. Below the passage 30, the transfer means is disposed. By doing so, the length of the passage 30 can be reduced to permit increase of the printing speed, and the foot print of the main assembly 1 can be made smaller.

The image transfer position is lower than the position of the recording material feeding, and the fixing position is further lower than the transfer position, so that the recording material P is fed along the gravity, and therefore, the leading edge is stable to permit smooth feeding.

As described in the foregoing, according to the present invention, the area occupied by the image forming apparatus can be reduced. The heat generated inside the main assembly can be effectively discharged. By the provision of the second heat discharging duct, the temperature rise in the main assembly of the apparatus can be effectively prevented. By the provision of the partition to prevent the heat from the fixing means reaches the image bearing member, the fixing means can be placed adjacent to the image bearing member. This is also effective to reduce the length of the sheet passage.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a recording material, comprising:

an image bearing member;

optical means for projecting light corresponding to image information onto said image bearing member;

developing means for developing a latent image formed on said image bearing member into a toner image;

transfer means for transferring the toner image onto a recording material;

fixing means for fixing the toner image transferred onto the recording material;

first supporting means for supporting the recording material to be fed to said transfer means; and second supporting means for supporting the recording material which has been subjected to a fixing operation of said fixing means;

wherein a supporting surface of said first supporting means for supporting the recording material and a supporting surface of said second supporting means for supporting the recording material are overlapped in a horizontal direction with said optical means therebetween;

wherein a sheet feeding position for feeding the recording material supported on said first supporting means, an image transfer position where said transfer means transfer the image, and an image fixing position where the toner image is fixed on the recording material, take lower position in the order named;

wherein a supporting surface of said second supporting means and a horizontal plane form an angle of 55–75 degrees.

2. An apparatus according to claim 1, wherein said first supporting means has a support on an outer casing of said apparatus and a recording material feeding cassette detachably mountable relative to said outer casing.

3. An apparatus according to claim 1, wherein said optical means includes laser beam emitting means for emitting a laser beam, wherein said laser beam emitting means includes a semiconductor laser, a polygonal mirror, a lens and a reflection mirror.

4. An image forming apparatus for forming an image on a recording material, comprising:

an image bearing member;

optical means for projecting light corresponding to image information onto said image bearing member;

developing means for developing a latent image formed on said image bearing member into a toner image;

transfer means for transferring the toner image onto a recording material;

fixing means for fixing the toner image transferred onto the recording material;

first supporting means for supporting the recording material to be fed to said transfer means;

second supporting means for supporting the recording material which has been subjected to a fixing operation of said fixing means;

wherein a supporting surface of said first supporting means for supporting the recording material and a supporting surface of said second supporting means for supporting the recording material are overlapped in a horizontal direction with said optical means therebetween;

discharging means, disposed along a back side of said second supporting means, for discharging air in said apparatus along said second supporting means;

wherein a sheet feeding position for feeding the recording material supported on said first supporting means, an image transfer position where said transfer means transfer the image, an image fixing position where the toner image is fixed on the recording material, take lower position in the order named; and wherein a supporting surface of said first supporting member and a horizontal plane form an angle of 60–90 degrees, and a supporting surface of said second supporting means and a horizontal plane form an angle of 55–75 degrees.

5. An apparatus according to claim 4, wherein said image bearing member is contained in a process cartridge further containing at least one of charging means, said developing means and a cleaning means, said process cartridge being detachably mountable to said apparatus.

6. An apparatus according to claim 4, wherein said image bearing member is contained in a process cartridge further containing charging means, said developing means or a cleaning means, said process cartridge being detachably mountable to said apparatus.

7. An apparatus according to claim 4, wherein said image bearing member is contained in a process cartridge further containing at least said developing means.

8. An image forming apparatus for forming an image on a recording material, comprising:

an image bearing member;

optical means for projecting light corresponding to image information onto said image bearing member;

developing means for developing a latent image formed on said image bearing member into a toner image;

transfer means for transferring the toner image onto a recording material;

fixing means for fixing the toner image transferred onto the recording material;

first supporting means for supporting the recording material to be fed to said transfer means;

second supporting means for supporting the recording material which has been subjected to a fixing operation of said fixing means; and a duct along said first supporting means, at a back side of said first supporting means, said duct being constituted by an inside of an outer casing of said image forming apparatus and a plate provided on an inside surface of said outer casing, wherein a supporting surface of said first supporting means for supporting the recording material and a supporting surface of said second supporting means for supporting the recording material are overlapped in a horizontal direction with said optical means therebetween, wherein a sheet feeding position for feeding the recording material supported on said first supporting means, an image transfer position where said transfer means transfer the image, and an image fixing position where the toner image is fixed on the recording material, take lower position in the order named.

9. An image forming apparatus for forming an image on a recording material, comprising:

an electrophotographic photosensitive drum;

an optical mechanism which projects light onto said electrophotographic photosensitive drum to form on said electrophotographic photosensitive drum an electrostatic latent image corresponding to image information;

a developing roller adjacent said electrophotographic photosensitive drum, said developing roller supplying toner to said electrophotographic photosensitive drum so that the latent image is developed into a toner image;

a transfer roller contacting said electrophotographic photosensitive drum at a transfer position at which the recording material is passed between said electrophotographic photosensitive drum and said transfer roller so that the toner image is transferred onto the recording material;

a heater for heating the toner image on the recording material at a fixing position;

a pressing rotatable member which applies pressure to the toner image on the recording material at the fixing position so that the toner image is fixed onto the recording material;

a first support on which is supported the recording material to be fed to the transfer position; and a second support on which is supported the recording material on which the toner image has been fixed, wherein a supporting surface of said first support and a supporting surface of said second support are overlapped in a horizontal direction with said optical mechanism therebetween, wherein a sheet feeding position for feeding the recording material supported on said first support, the transfer position, and the fixing position take lower positions in the order named; and, wherein the supporting surface of said second support and a horizontal plane form an angle of 55–75 degrees.

10. An apparatus according to claim 9, wherein said first support has a supporting member on an outer casing of said apparatus and a recording material feeding cassette detachably mountable relative to said outer casing.

11. An apparatus according to claim 9, wherein said optical mechanism includes a semiconductor laser, a polygonal mirror, a lens, and a reflection mirror.

12. An image forming apparatus for forming an image on a recording material, comprising:

an electrophotographic photosensitive drum;

an optical mechanism which projects light onto said electrophotographic photosensitive drum to form on said electrophotographic photosensitive drum an electrostatic latent image corresponding to image information;

a developing roller adjacent said electrophotographic photosensitive drum, said developing roller supplying toner to said electrophotographic photosensitive drum so that the latent image is developed into a toner image;

a transfer roller contacting said electrophotographic photosensitive drum at a transfer position at which the recording material is passed between said electrophotographic photosensitive drum and said transfer roller so that the toner image is transferred onto the recording material;

a heater for heating the toner image on the recording material at a fixing position;

a pressing rotatable member which applies pressure to the toner image on the recording material at the fixing position so that the toner image is fixed onto the recording material;

a support on which the recording material is supported; and a discharge duct, disposed along a back side of said support, through which air inside said apparatus is discharged along said support, wherein said support includes a first supporting member for supporting the recording material to be fed to the transfer position.

13. An apparatus according to claim 12, wherein at a back side of said first supporting member, there is provided an additional duct along said first supporting member, said additional duct being constituted by an inside of an outer casing of said image forming apparatus and a plate provided on an inside surface of said outer casing.

14. An apparatus according to claim 12, wherein said first supporting member has a support on an outer casing of said apparatus and a recording material feeding cassette detachably mountable relative to said outer casing.

15. An apparatus according to claim 12, 13 or 14, wherein a supporting surface of said first supporting member and a horizontal plane form an angle of 60–90 degrees.

16. An image forming apparatus for forming an image on a recording material, comprising:

an electrophotographic photosensitive drum;

an optical mechanism which projects light onto said electrophotographic photosensitive drum to form on said electrophotographic photosensitive drum an electrostatic latent image corresponding to image information;

a developing roller adjacent said electrophotographic photosensitive drum, said developing roller supplying toner to said electrophotographic photosensitive drum so that the latent image is developed into a toner image;

a transfer roller contacting said electrophotographic photosensitive drum at a transfer position at which the recording material is passed between said electrophotographic photosensitive drum and said transfer roller so that the toner image is transferred onto the recording material;

a heater for heating the toner image on the recording material at a fixing position;

a pressing rotatable member which applies pressure to the toner image on the recording material at the fixing position so that the toner image is fixed onto the recording material;

a first supporting member on which is supported the recording material to be fed to the transfer position;

a second supporting member on which is supported the recording material on which the toner image has been fixed, wherein a supporting surface of said first supporting member and a supporting surface of said second supporting member are overlapped in a horizontal direction with said optical mechanism therebetween; and a discharge duct, disposed along a back side of said second supporting member, for discharging air in said apparatus along said second supporting member, wherein a sheet feeding position for feeding the recording material supported on said first supporting member, the transfer position, and the fixing position take lower positions in the order named, and wherein a supporting surface of said first supporting member and a horizontal plane form an angle of 60–90 degrees, and a supporting surface of said second supporting member and a horizontal plane form an angle of 55–75 degrees.

17. An apparatus according to claim 16, wherein said electrophotographic photosensitive drum is contained in a process cartridge further containing at least one of a charging roller, said developing roller and a cleaning blade, said process cartridge being detachably mountable to said apparatus.

18. An apparatus according to claim 16, wherein said electrophotographic photosensitive drum is contained in a process cartridge further containing a charging roller, said developing roller or a cleaning blade, said process cartridge being detachably mountable to said apparatus.

19. An apparatus according to claim 16, wherein said electrophotographic photosensitive drum is contained in a process cartridge further containing at least said developing roller.

20. An image forming apparatus for forming an image on a recording material, comprising:

an electrophotographic photosensitive drum;

an optical mechanism which projects light onto said electrophotographic photosensitive drum to form on said electrophotographic photosensitive drum an electrostatic latent image corresponding to image information;

a developing roller adjacent said electrophotographic photosensitive drum, said developing roller supplying toner to said electrophotographic photosensitive drum so that the latent image is developed into a toner image;

a transfer roller contacting said electrophotographic photosensitive drum at a transfer position at which the recording material is passed between said electrophotographic photosensitive drum and said transfer roller so that the toner image is transferred onto the recording material;

a heater for heating the toner image on the recording material at a fixing position;

a pressing rotatable member which applies pressure to the toner image on the recording material at the fixing position so that the toner image is fixed onto the recording material;

a first supporting member on which is supported the recording material to be fed to the transfer position;

a second supporting member on which is supported the recording material on which the toner image has been fixed; and a duct along said first supporting member, at a back side of said first supporting member, said duct being constituted by an inside of an outer casing of said image forming apparatus and a plate provided on an inside surface of said outer casing, wherein a supporting surface of said first supporting member and a supporting surface of said second supporting member are overlapped in a horizontal direction with said optical mechanism therebetween, and wherein a sheet feeding position for feeding the recording material supported on said first supporting mechanism, the transfer position, and the fixing position take lower positions in the order named.

21. An image forming apparatus for forming an image on a recording material, comprising:

an image bearing member;

optical means for projecting light corresponding to image information onto said image bearing member;

developing means for developing a latent image formed on said image bearing member into a toner image;

transfer means for transferring the toner image onto the recording material;

fixing means for fixing the toner image transferred onto the recording material;

supporting means for supporting the recording material;

air intake means, provided in a bottom portion of a main body of said apparatus, for taking air into inside of said apparatus;

an electrical part electrically connected with an electric circuit substrate, said electrical part disposed vertically between said fixing means and said bottom portion; and discharging means, disposed along a back side of said supporting means above said fixing means, for discharging air inside said apparatus along said supporting means.

22. An apparatus according to claim 21, wherein said supporting means includes a first supporting member for supporting the recording material to be fed to said transfer means, and wherein air heated by heat generated by the electrical part is discharged through said discharging means in the form of a duct disposed behind said first supporting member.

23. An apparatus according to claim 21, wherein said supporting means includes a second supporting member for supporting the recording material which has been subjected to a fixing operation of said fixing means, and wherein air heated by heat generated by said fixing means is discharged through said discharging means in the form of a duct disposed behind said first supporting member.

24. An apparatus according to claim 21, wherein said supporting means has a first supporting member for supporting the recording material to be fed to said transfer means and a second supporting member for supporting the recording material which has been subjected to a fixing operation of said fixing means, wherein a supporting surface of said first supporting means for supporting the recording material and a supporting surface of said second supporting means for supporting the recording material are overlapped in a horizontal direction with said optical means therebetween.

25. An apparatus according to claim 21, wherein a sheet feeding position for feeding the recording material supporting on said supporting means, an image transfer position where said transfer means transfer the image, an image fixing position where the toner image is fixed on the recording material, take lower position in the order named.

26. An apparatus according to claim 23, wherein said discharging means has a duct at a back side of said second supporting member along said second supporting member, said duct extending from said fixing means to discharge heat generated at a heat generating portion of said fixing means to an outside of said apparatus.

27. An apparatus according to claim 26, wherein said duct is constituted by an inside surface of a cover for permitting mounting and demounting of a process cartridge relative to said image forming apparatus, and by a plate on an inside surface of the cover.

28. An apparatus according to claim 22, wherein at a back side of said first supporting member, there is provide a duct along said first supporting member, said duct being constituted by an inside of an outer casing of said image forming apparatus and a plate provided on an inside surface of said outer casing.

29. An apparatus according to claim 22, wherein said first supporting member has a support on an outer casing of said apparatus and a recording material feeding cassette detachably mountable relative to said outer casing.

30. An apparatus according to claim 23, wherein said second supporting member is constituted by an outer surface of the cover and a slider slidable relative to the cover.

31. An apparatus according to claim 30, wherein the cover is rotatably mounted to an outer casing of said apparatus.

32. An apparatus according to claim 22, 25, 28 or 29, wherein a supporting surface of said first supporting member and a horizontal plane form an angle of 60–90 degrees.

33. An apparatus according to claim 23, 24 or 30, wherein a supporting surface of said second supporting member and a horizontal plane form an angle of 55–75 degrees.

34. An image forming apparatus for forming an image on a recording material, comprising:

mounting means for detachably mounting a process cartridge having an electrophotographic photosensitive member and process means actable on said photosensitive member;

optical means for projecting light corresponding to image information onto the photosensitive member of said process cartridge;

transfer means for transferring a toner image formed on said photosensitive member onto a recording material;

fixing means for fixing the toner image transferred onto the recording material;

supporting means for supporting the recording material;

air intake means, provided in a bottom portion of a main body of said apparatus, for taking air into inside of said apparatus;

an electrical part electrically connected with an electric circuit substrate, said electrical part disposed vertically between said fixing means and said bottom portion; and discharging means, disposed along a back side of said supporting means, disposed along a back side of said supporting means above said fixing means, for discharging air inside said apparatus along said supporting means.

35. An apparatus according to claim 34, wherein said process means includes at least one of a developing member for developing a latent image formed on said photosensitive member, a charging member for charging said photosensitive member and a cleaning member for removing residual matter from said photosensitive member.

36. An apparatus according to claim 34, wherein said supporting means includes a first supporting member for supporting the recording material to be fed to said transfer means, and wherein air heated by heat generated by the electrical part is discharged through said discharging means in the form of a duct disposed behind said first supporting member.

37. An apparatus according to claim 34, wherein said supporting means includes a second supporting member for supporting the recording material which has been subjected to a fixing operation of said fixing means, and wherein air heated by heat generated by said fixing means is discharged through said discharging means in the form of a duct disposed behind said first supporting member.

38. An apparatus according to claim 34, wherein said supporting means has a first supporting member for supporting the recording material to be fed to said transfer means and a second supporting member for supporting the recording material which has been subjected to a fixing operation of said fixing means, wherein a supporting surface of said first supporting member for supporting the recording material and a supporting surface of said second supporting member for supporting the recording material are overlapped in a horizontal direction with said optical means therebetween.

39. An apparatus according to claim 34, wherein a sheet feeding position for feeding the recording material supporting on said supporting means, an image transfer position where said transfer means transfer the image, an image fixing position where the toner image is fixed on the recording material, take lower position in the order named.

40. An apparatus according to claim 37, wherein said discharging means has a duct at a back side of said second supporting member along said second supporting member, said duct extending from said fixing means to discharge heat generated at a heat generating portion of said fixing means to an outside of said apparatus.

41. An apparatus according to claim 40, wherein said duct is constituted by an inside surface of a cover for permitting mounting and demounting of a process cartridge relative to said image forming apparatus, and by a plate on an inside surface of the cover.

42. An apparatus according to claim 36, wherein at a back side of said first supporting member, there is provide a duct along said first supporting member, said duct being constituted by an inside of an outer casing of said image forming apparatus and a plate provided on an inside surface of said outer casing.

43. An apparatus according to claim 36, wherein said first supporting member has a support on an outer casing of said apparatus and a recording material feeding cassette detachably mountable relative to said outer casing.

44. An apparatus according to claim 37, wherein said second supporting member is constituted by an outer surface of the cover and a slider slidable relative to the cover.

45. An apparatus according to claim 44, wherein the cover is rotatably mounted to an outer casing of said apparatus.

46. An apparatus according to claim 36, 39, 42 or 43, wherein a supporting surface of said first supporting member and a horizontal plane form an angle of 60–90 degrees.

47. An apparatus according to claim 37, 38, or 44, wherein a supporting surface of said second supporting member and a horizontal plane form an angle of 55–75 degrees.

48. An apparatus according to claim 21 or 34, wherein said electrical part includes a controller, an AC input portion, voltage generating means, or a motor.

* * * * *

UNITED STATES PATENT AND TRADEMARK OFFICE

CERTIFICATE OF CORRECTION

PATENT NO. : 5,907,745

DATED : May 25, 1999

INVENTOR(S) : JUN AZUMA, ET AL.

It is certified that error appears in the above-identified patent and that said Letters Patent is hereby corrected as shown below:

COVER PAGE AT ITEM [56] FOREIGN PATENT DOCUMENTS,
"61-168167 8/1985 Japan" should be deleted.

COLUMN 3,
Line 22, "includes" should read --include--; and
Line 34, "is" should read --are--.

COLUMN 5,
Line 52, "a2" should read --A2--.

COLUMN 7,
Line 2, "f" should read --of--; and
Line 17, "The 61" should read --The transfer roller 61--.

COLUMN 8,
Line 47, "heat flow H1" should be deleted.

COLUMN 9,
Line 64, "heat flow H5" should be deleted.

COLUMN 11,
Line 44, "further" should be deleted;
Line 52, "LED" should read --LEDs--; and

UNITED STATES PATENT AND TRADEMARK OFFICE

CERTIFICATE OF CORRECTION

PATENT NO. : 5,907,745

DATED : May 25, 1999

INVENTOR(S) : JUN AZUMA, ET AL.

It is certified that error appears in the above-identified patent and that said Letters Patent is hereby corrected as shown below:

COLUMN 11
Line 53, "LED" should read --LEDs--.

COLUMN 12,
Line 14, "are" should read --is--; and
Line 24, "unshaped" should read --u-shaped--.

COLUMN 18,
Line 21, "ing" should read --ed--; and
Line 36, "provide" should read --provided--.

COLUMN 20,
Line 3, "ing" should read --ed--; and
Line 20, "provide" should read --provided--.

Signed and Sealed this
Fourth Day of January, 2000

*Attest:*

*Attesting Officer*

*Acting Commissioner of Patents and Trademarks*